US006334596B1

(12) United States Patent
Temple

(10) Patent No.: US 6,334,596 B1
(45) Date of Patent: Jan. 1, 2002

(54) SIGN SUPPORT SYSTEM

(76) Inventor: Boyd K. Temple, 3506 Windsor Rd. SW., Roanoke, VA (US) 24016

( * ) Notice: Subject to any disclaimer, the term of this patent is extended or adjusted under 35 U.S.C. 154(b) by 0 days.

(21) Appl. No.: 09/335,901

(22) Filed: Jun. 18, 1999

(51) Int. Cl.[7] ..... A45F 3/44
(52) U.S. Cl. ..... 248/156
(58) Field of Search ..... 248/156, 545, 248/219.4, 292.13; 29/254, 275; 40/606, 607, 604

(56) References Cited

U.S. PATENT DOCUMENTS

| | | | | |
|---|---|---|---|---|
| 1,754,929 A | | 4/1930 | Atticks et al. | |
| 2,263,112 A | | 11/1941 | Warrant | |
| 2,765,554 A | | 10/1956 | Anderson et al. | |
| 3,143,817 A | | 8/1964 | Paulson | |
| 3,425,127 A | | 2/1969 | Long et al. | |
| 3,850,401 A | * | 11/1974 | Snediker | 248/291 |
| 3,891,091 A | | 6/1975 | Anderson | |
| 4,249,715 A | | 2/1981 | Repp | |
| 4,279,104 A | * | 7/1981 | Classen | 52/38 |
| 4,326,352 A | | 4/1982 | Barth | |
| 4,357,772 A | | 11/1982 | Amick et al. | |
| 4,378,650 A | | 4/1983 | Ottoson | |
| 4,441,679 A | | 4/1984 | Calet | |
| 4,524,533 A | | 6/1985 | Still | |
| 4,910,901 A | | 3/1990 | Boyar | |
| 5,176,344 A | * | 1/1993 | Eberhard | 248/156 |
| 5,388,794 A | * | 2/1995 | Wolff | 248/219.4 |
| 5,463,973 A | * | 11/1995 | Tait | 40/607 |
| 5,472,102 A | | 12/1995 | Clayton | |
| 5,502,910 A | | 4/1996 | Lucchesi | |
| 5,626,320 A | | 5/1997 | Burrell et al. | |
| 5,702,010 A | | 12/1997 | Liang | |
| 5,775,652 A | | 7/1998 | Crawshaw et al. | |
| 5,803,273 A | | 9/1998 | Menaged et al. | |

* cited by examiner

*Primary Examiner*—Ramon O. Ramirez
*Assistant Examiner*—Jerome DeLuca
(74) *Attorney, Agent, or Firm*—Pillsbury Winthrop LLP

(57) ABSTRACT

Provided is a unique sign support system having a self-contained installation and extraction system which is effective for temporarily attaching the sign support system to soft or hard ground with minimal effort and without the requirement for additional tools. The sign support system further provides for independent vertical and horizontal size adjustments to permit the sign support to adapt to a variety sizes of signs and spatial limitations. The invention further provides a unique vertical support assembly having a self-contained installation and extraction system which is effective for temporarily attaching the vertical support assembly to soft or hard ground, the vertical support assembly then being adapted for a wide variety of uses, to include tent supports, temporary lawn awning supports and other such temporary vertical support requirements. The invention also provides a unique crossbar assembly which can be employed to connect any two or more vertical supports and having multiple universally adaptable attachment points along its length can be adapted for a wide variety of uses. Also provided is a sign system kit.

12 Claims, 8 Drawing Sheets

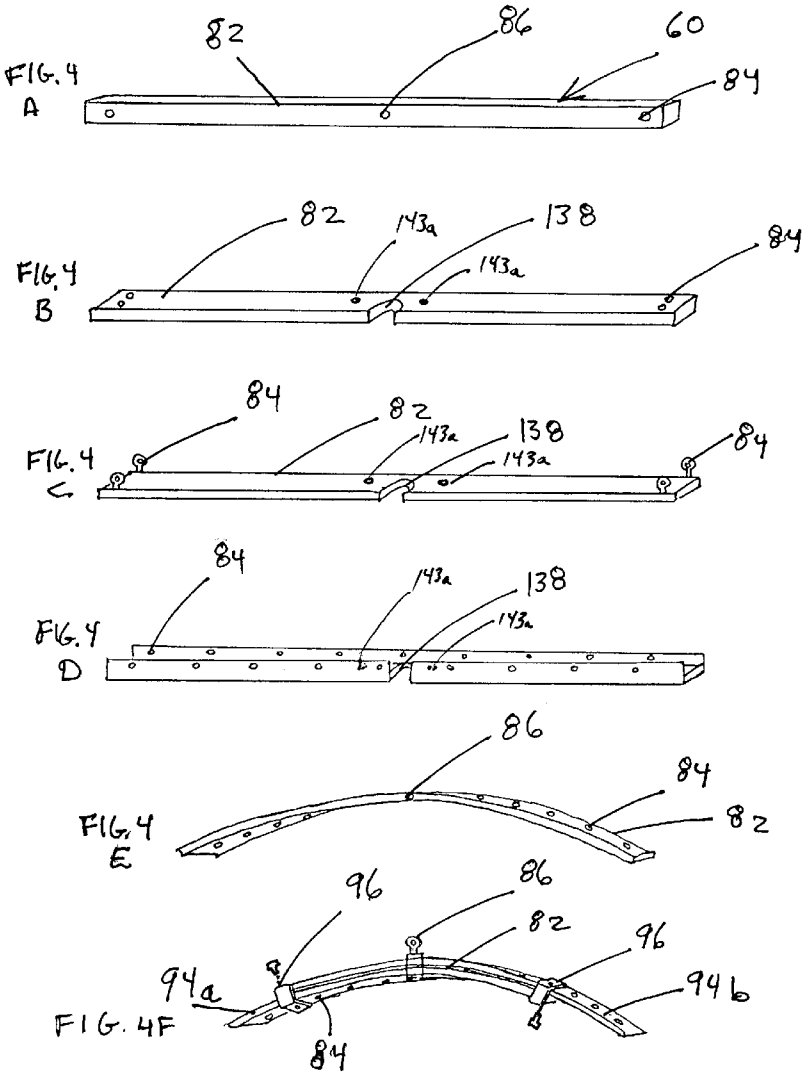
60
84
86
82
FIG. 4 A
138
143a
143a
82
84
FIG. 4 B
84
138
143a
143a
82
84
FIG. 4 C
138
143a
143a
84
FIG. 4 D
84
82
86
FIG. 4 E
96b
96
86
82
96
84
94a
FIG. 4F
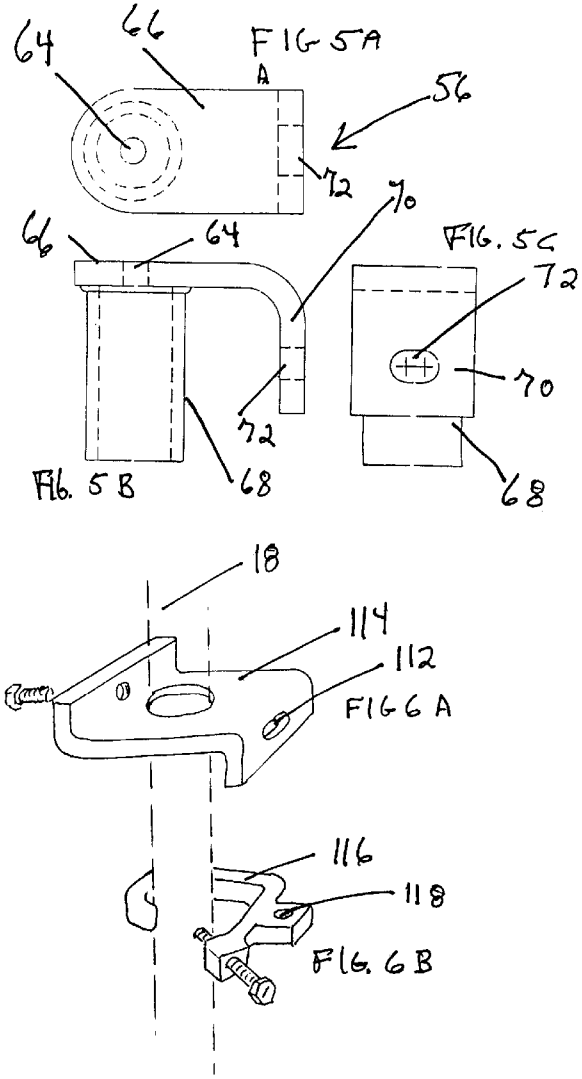
56
FIG. 5A
72
66
64
70
72
68
64
66
FIG. 5B
FIG. 5C
72
70
68
18
114
112
FIG 6A
116
118
FIG. 6B

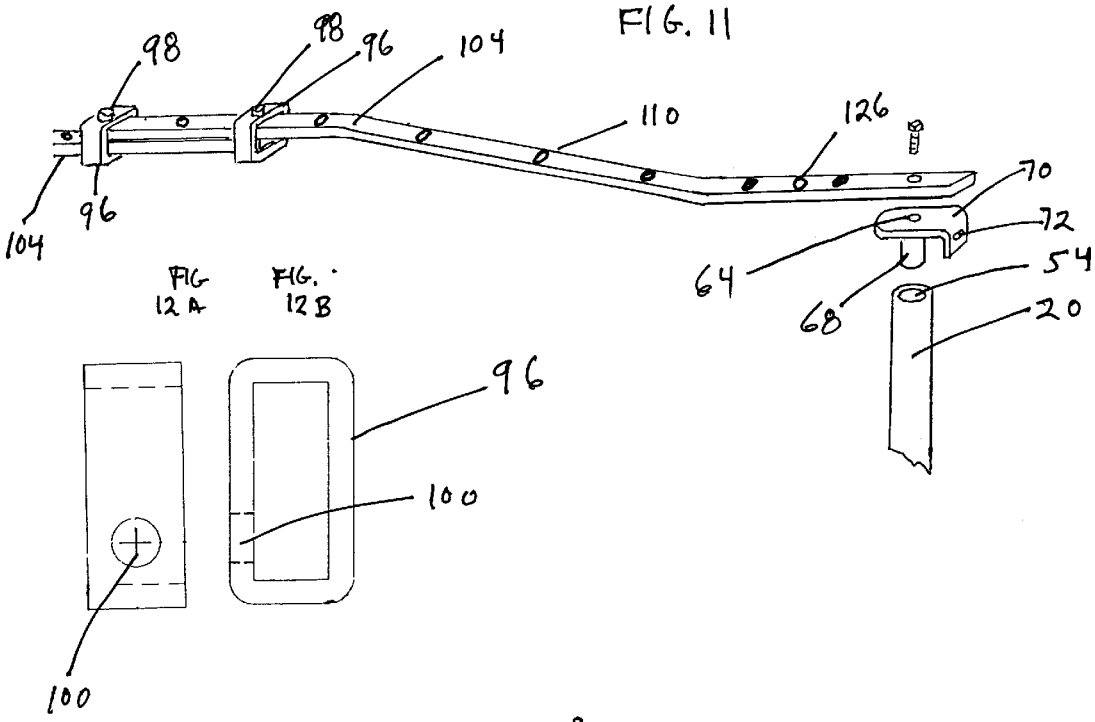
FIG. 11
98
98
96
104
110
126
70
72
64
54
68
20
104
96
FIG 12A
FIG. 12B
96
100
100
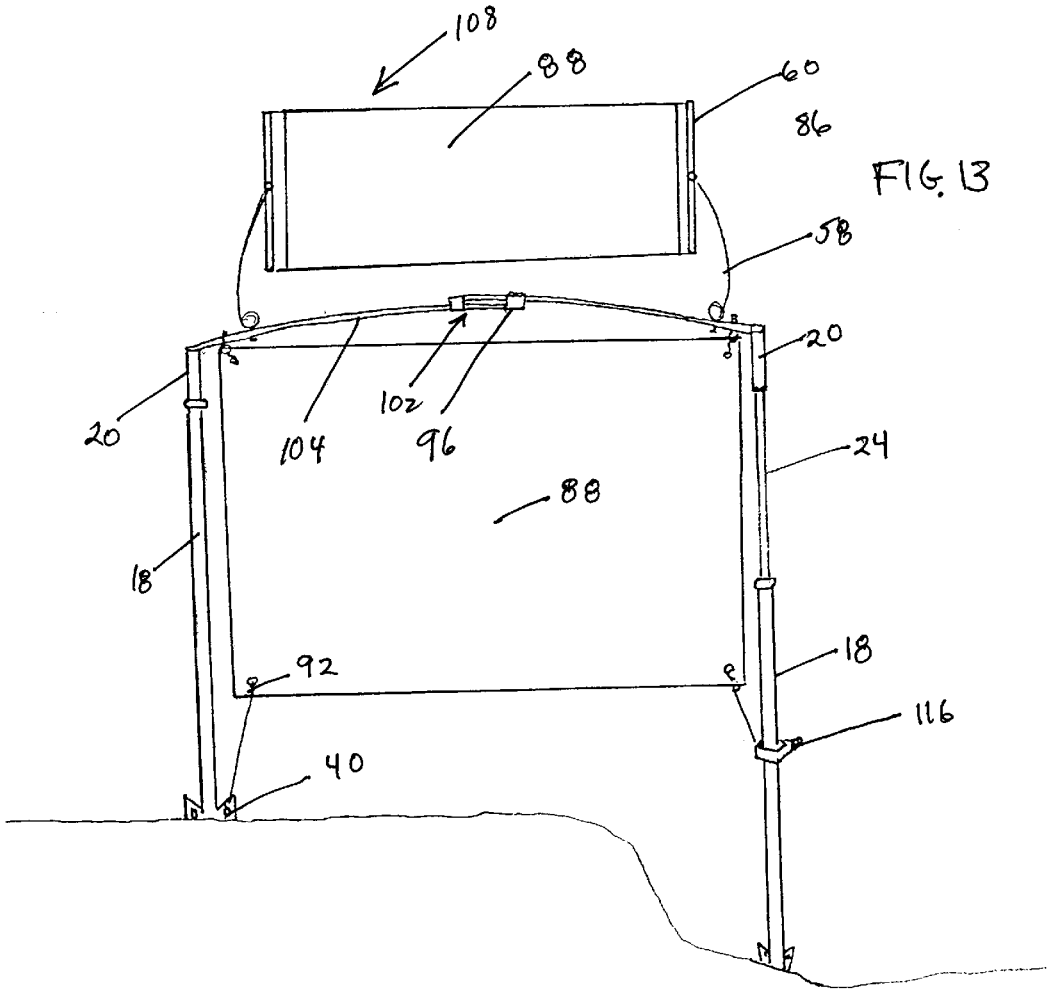
108
88
60
86
FIG. 13
58
20
20
102
104
96
24
88
18
18
92
116
40

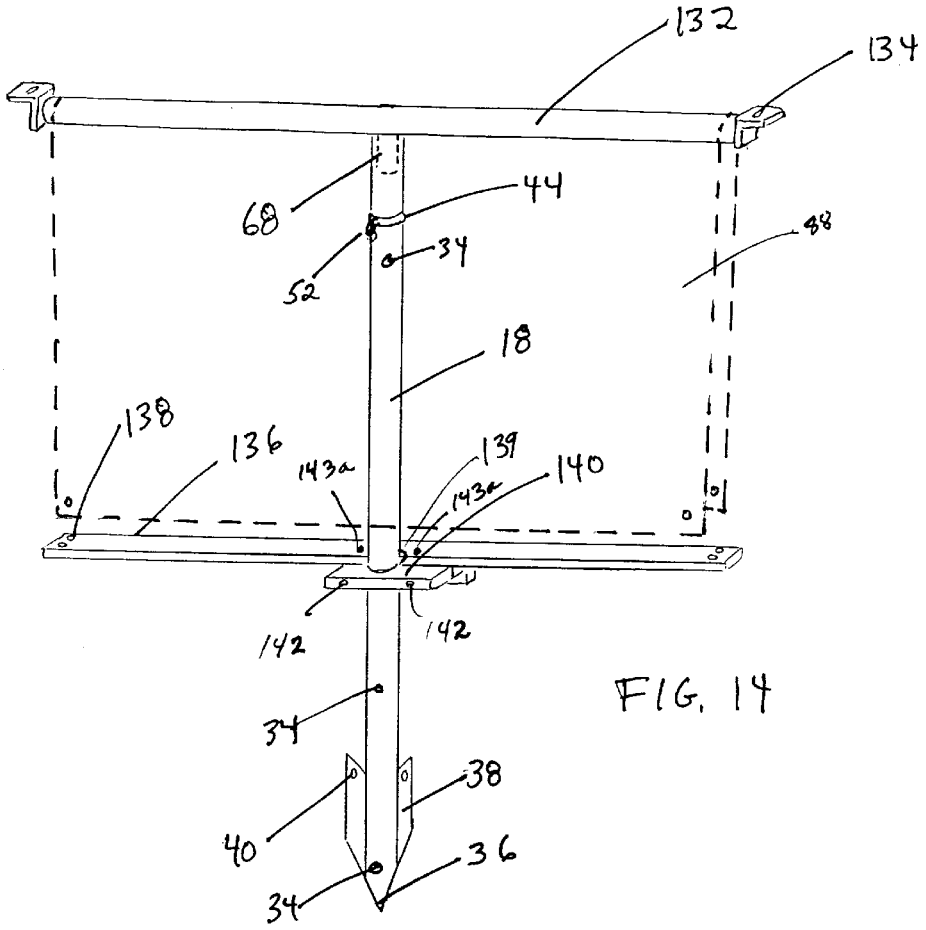
FIG. 14
FIG. 15A
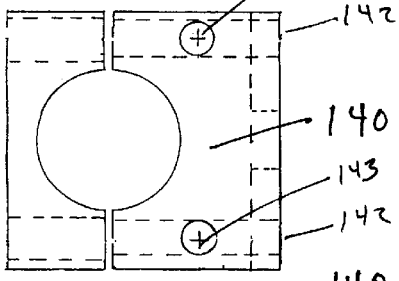
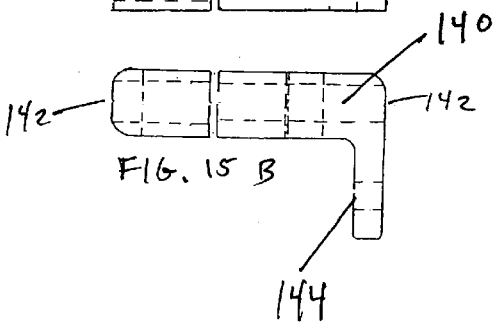
FIG. 15 B
FIG. 15 C
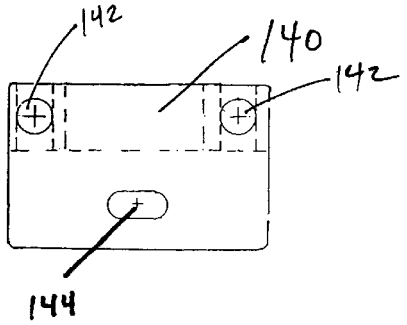

SIGN SUPPORT SYSTEM

FIELD OF THE INVENTION

This invention relates to sign support systems and more particularly to a novel telescoping sign support system having a self-contained driving and extracting mechanism for temporarily attaching the sign system to the ground.

BACKGROUND

The temporary placement of signs has historically been viewed as a commercial necessity in many industries; particularly as an advertising tool in the marketing of real estate and other forms of property. Temporarily placed signs have also been used in non-commercial displays such as for political campaign promotions, public announcements, and required official public notices by agencies of local governments.

The display of information using signs supported in a vertical arrangement, which are temporarily attached to the ground, continues to find new useful applications. While attempts to provide an effective sign support system with universal applications have been made, many problems experienced by users remain unresolved by conventional systems.

Temporary sign supports currently known in the art have typically been limited to simple variations of sign posts which are designed for use in limited applications. Further, such conventional sign posts are often restricted for use with a particular type, shape, and material of sign.

For example, Paulson , U.S. Pat. No. 3,143,817 discloses a single post sign holder configured to display highway signs, specifically rigidly constructed signs which are configured and displayed such that two corners of the attached sign must be aligned along a vertical axis and sized to fit within the provided sign securing points. The Paulson sign post includes a sliding hammer which is intended for driving the sign post into the ground and removing the same. Paulson's self-contained driving mechanism is configured with driver contact points located entirely within the handle of the device. This configuration results in a very limited throw distance before each impact of the driver. The design of this driving mechanism seriously limits the effectiveness of the device in penetrating ground of hard nature. In fact, Paulson discusses this problem and teaches the very conventional remedy of using a hammer to drive the post into hard ground. This self-admitted shortcoming of the Paulson device limits the self-driving mechanism to effective use only in soft ground; a result which is hardly better than a standard metal sign post. Paulson teaches the use of its sign post with signs of rigid material construction of a size and configuration which will fit between two holding points on the sign post. The height of the post is not adjustable, there are no structural connecting points to which crossbars can be attached to other posts or to which any attachments can be made, and signs of various configuration or signs constructed of soft fabric material cannot be effectively secured to the Paulson sign post.

Another more recent effort to provide an improved sign post assembly is disclosed in Boyar, U.S. Pat. No. 4,910,901. Boyar discloses a sign post assembly with a slide hammer, the design of which is limited to driving the post into the ground. Boyar does not provide a structure by which it is possible to include a self-contained extraction mechanism that can be used to remove the post from the ground. Further, the design of the Boyar sign post assembly limits the useful applications and types of signs which can be effectively displayed. Boyar only provides for and teaches the display of a cantilever signs. The limited structure of Boyar only allows for signs connected along a top edge to an extended horizontal bar attached to the vertical sign posts. This configuration is very conventional and is routinely employed for small real estate sales signs placed in the front yards of homes being offered for sale or rent. The sign post assembly of Boyar is designed for that application only and would be entirely unsuitable for use as a support for a flexible fabric sign due to the effect of wind on such non-rigid signs.

Lucchesi, U.S. Pat. No. 5,502,910 discloses a real estate sign pole which can be used with a separately provided non-integral slide hammer. The sign pole of Lucchesi must be in a disassembled state prior to using the separate slide hammer to drive the pole into the ground. After the pole has been driven into the ground, the sign pole disclosed by Lucchesi requires several steps for assembly of the sign pole, including attaching a covering sleeve over a slotted opening in the post and attaching a top portion, which is configured with a 90° bend such that the sign support is configured horizontal to the ground. The Lucchesi sign pole cannot be driven into the ground with an integrally provided slide hammer and after being driven into the ground cannot be configured to support a sign without complete removal and disassembly of the slide prior to reassembly to form the basic vertical sign post. After reassembly, the horizontal support is configured to hold hanging signs which are connected to the Lucchesi device only along the top edge of the sign. Such a connection provides poor support for light-weight signs due to the effect of wind. The Lucchesi sign pole is of a fixed height unless an additional piece of pipe of fixed length is inserted between the bottom portion of the post and the upper portion with the 90° bend during the assembly process. The Lucchesi sign pole, therefore, is limited to one of two selected heights, depending upon whether or not the additional fixed length extension tube is included in the assembly step.

None of the conventional sign posts, alone or in combination, fully meets the majority of the needs of users.

As demonstrated above, the need to provide a sign system easily adapted for a variety of applications and sign material types, on even or uneven terrain, which are easily positioned in the ground without the need for additional tools or assembly, highly stable during use, and easily removed after use has not been met by conventional sign support technology. The present invention is provided to meet the identified multiple needs for an effective sign support system.

SUMMARY OF THE INVENTION

The sign support system of the present invention provides a unique self-contained telescoping vertical support assembly which can be easily adapted for use with a wide variety of sign shapes, sizes and material of rigid or soft flexible composition. The sign support system of the present invention can be easily positioned in the ground or removed from the ground using only the self-contained driving mechanism. The present invention is further designed to be used as a one-post, two-post, or multi-post sign system thereby providing added adaptability to a wide variety of sign sizes and configurations. The sign support system further provides for independent vertical and horizontal size adjustments to permit the sign support to adapt to a variety sizes of signs and spatial limitations. Further, the sign support system is configured to be quickly affixed to the ground, easily assembled, stable during use, and compactly stored when not in use.

An object of the present invention is to provide a highly versatile sign support system for temporarily displaying a wide variety of sign shapes, sizes, and materials of fabrication on even or uneven terrain without the need for additional ground installation tools or equipment.

Another object of the present invention is to provide a telescoping vertical support assembly which can be temporarily affixed to and supported in soft or hard ground. The vertical support assembly includes a self-contained driving and extracting mechanism, and multiple vertical support assemblies can be interconnected, using a novel crossbar assembly, to provide a superior support system for a wide variety of applications.

Another object of the present invention is to provide a sign system kit which includes at least one telescoping vertical support assembly having a self-contained driving and extracting mechanism, and at least one crossbar assembly, which is adapted to easily connect two or more vertical support assemblies, one to another, to form a multi-poled sign support system. The sign system kit can also be provided with a variety of attachments, which can be selected by the user as desired to meet a wide variety of applications, to include the display of multiple signs from a singular telescoping pole. The sign system kit can also be provided with a blank sign manufactured of soft or rigid material which can be imprinted as the user desires either before or after being removably attached to the sign support system. Optionally, the sign system kit can also include imprinting materials and appliques which can be used by the user to produce inexpensive displays of information which present a professional appearance to the viewer.

BRIEF DESCRIPTION OF THE DRAWINGS

The invention will now be described, by way of illustration only, with reference to the accompanying drawings.

FIGS. 4A–F show optional horizontal supports for use with the sign system of the present invention;

FIGS. 5A–C show three views of a top plug member for use with a vertical support assembly of the present invention;

FIGS. 6A–B show alternative attachment connectors for use with a vertical support assembly of the present invention;

FIG. 11 is a partial view of the sign support system of the present invention, which shows the detail of the sliding connector for the crossbar assembly as shown in FIG. 10, an exploded view of the connection between the crossbar assembly and the top of one of the vertical support assemblies and a top plug member disposed between the crossbar assembly and the vertical support assembly;

FIGS. 12A–B show two detail views of the crossbar assembly locking retainer as shown in FIG. 11;

FIG. 13 is a front elevation view of a multi-pole application of the present invention positioned relative to uneven terrain, which depicts the leveling feature of a two-vertical support configuration of the sign support system of the present invention;

FIG. 14 is a prospective view of an additional embodiment of the sign support system of the present invention configured to support a two sided soft material sign on a single-vertical support assembly;

FIGS. 15A–C show three views of another embodiment of an attachment connection member for use with the vertical support assembly of the present invention.

DETAILED DESCRIPTION

Figure 1:
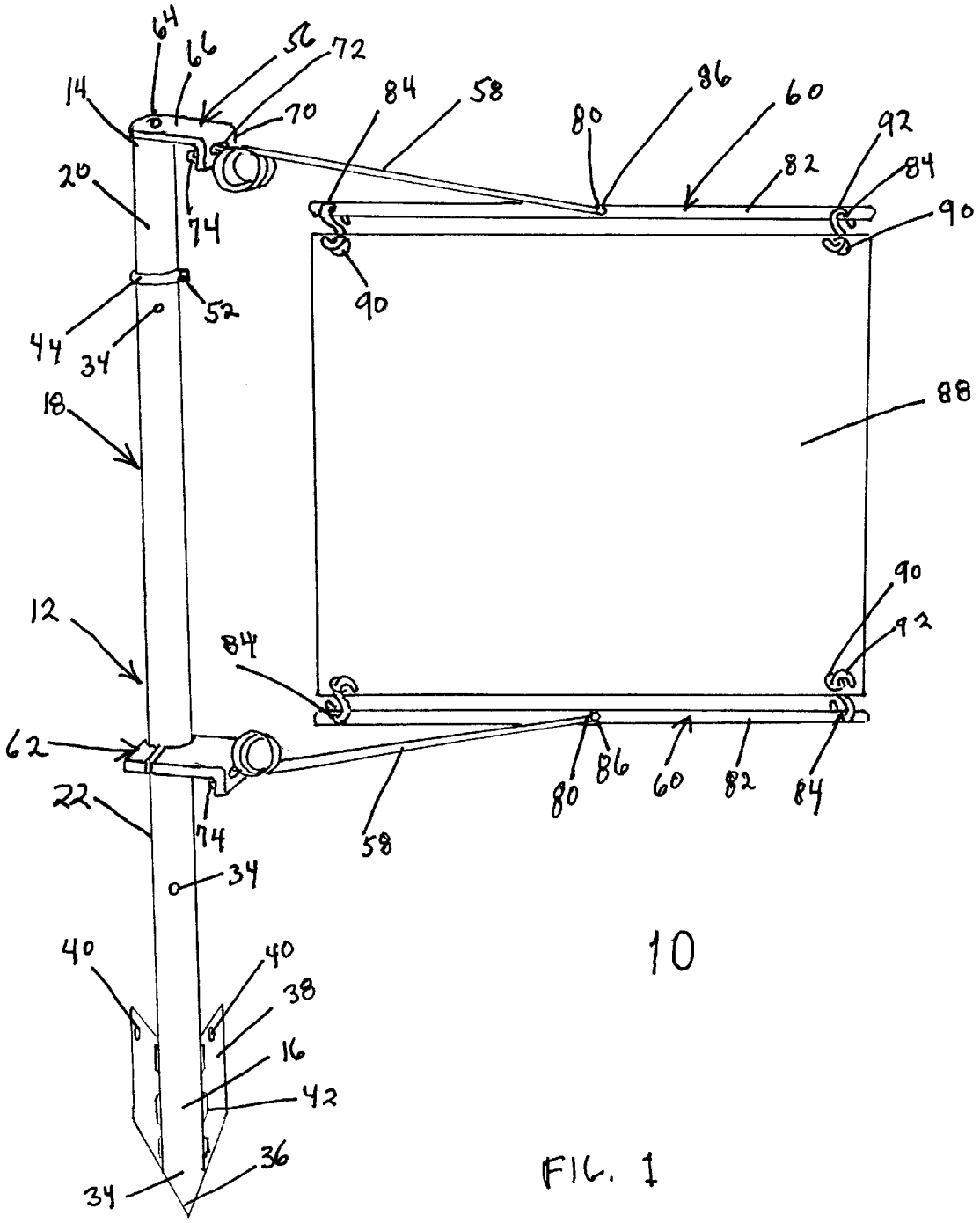
FIG. 1 is a perspective view of the preferred embodiment of the sign support system of the present invention shown with a soft fabric sign mounted therein.

The sign support system of the present invention can be adapted for use on virtually any terrain to support a wide variety of sign types, configurations, and materials of fabrication. Further, the telescoping vertical support assembly of the sign support system can be configured for a variety of other uses not related to sign support. The following detailed description of a non-limiting preferred embodiment is provided for purposes of demonstrating the novel characteristics of the present invention.

The following description relates to FIGS. 1–9. The apparatus of the present invention is a sign support system as generally shown at 10.

In its most general form, the sign support system 10 of the present invention includes a vertical support assembly, generally shown at 12, having a top end 14 and a bottom end 16. An elongated vertical shaft, generally shown at 18, includes a handle portion 20, which is disposed at the top end 14 of the sign support system 10 and a tubular lower shaft portion 22, which is disposed at the bottom end 16 of the sign support system 10. Steel, metal alloys thereof, impact resistant composites or polymers and like materials can be used in the manufacture of the sign support system 10. The components of the present invention can be constructed using techniques which are known in the art to include, for example, welding, casting, molding and the like.

Figure 3A:
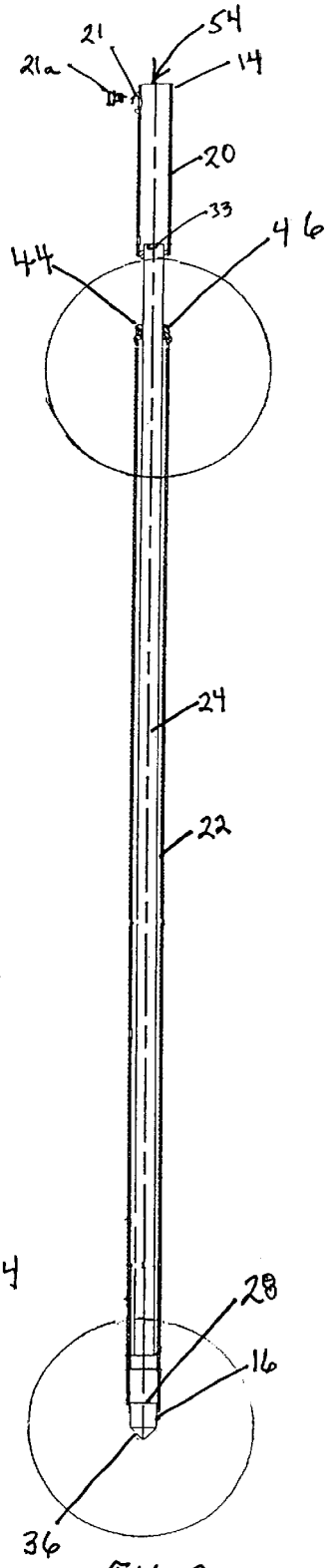
FIG. 3A is a sectional view, taken along line A—A, of the vertical support assembly of the present invention as shown in FIG. 2.
Figure 3C:
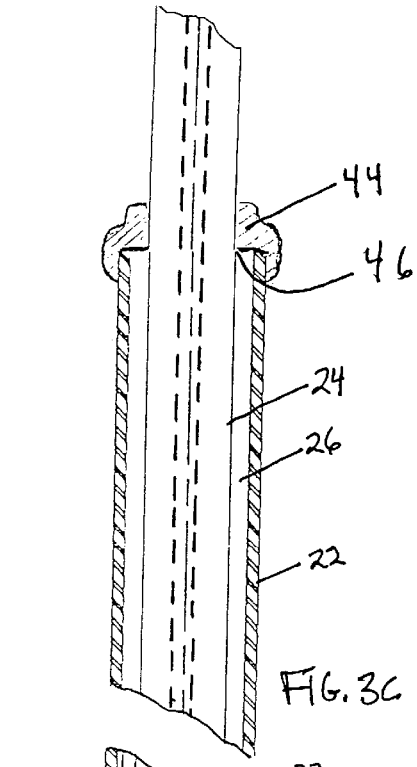
FIG. 3C is an enlarged detail sectional view of the top portion of the vertical support assembly of the present invention as shown in FIG. 3A.
Figure 3B:
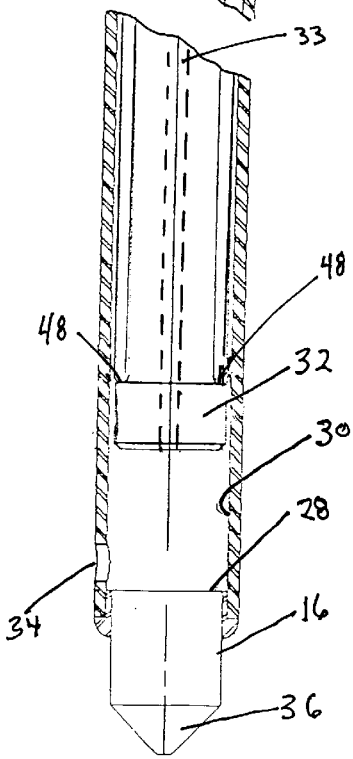
FIG. 3B is an enlarged detail sectional view of the bottom portion of the vertical support assembly of the present invention as shown in FIG. 3A.

As best shown in FIGS. 3A and 3B, the bottom end of the handle portion 20 is attached to a slide hammer shaft 24, which is sized and configured to easily slide within the lower shaft lumen 26 of the lower shaft portion 22. The portion of the shaft lumen 26 proximate to the bottom end 16 is provided with an installation impact surface 28. The installation impact surface 28 can be configured as at least one inwardly directed extension of the inner wall 30 of the lower shaft portion 22. The installation impact surface 28 is configured to obstruct at least a portion of the lower shaft lumen 26. Optionally, the installation impact surface 28 can be configured as an annular ring shaped extension of the inner wall 30 such that the installation impact surface 28. As best shown in FIG. 3B, the installation impact surface preferably can be configured to form the bottom wall of the lower shaft lumen 26, proximate to the bottom end 16. The installation impact surface 28 is manufactured of impact resistant materials so as to withstand forceful and repeated impacts which might be required to install a portion of the bottom end 16 of the vertical support assembly 12 into ground ranging from soft to hard degrees of compactness.

As best shown in FIG. 3B, an impact element 32 can be provided at the end of the slide hammer shaft 24. The impact element 32 is weighted, sized and configured to provide forceful contact against the installation impact surface 28 when the slide hammer shaft 24 is forced downward through the lower shaft lumen 26. The impact element 32 is preferably configured to fully cover the bottom end of the slide hammer shaft 24. Further, the impact element 32 can be sized to extend laterally outward beyond the cross dimension of the slide hammer shaft 24 toward the inner wall 30 of the lower shaft lumen 26, yet still avoid contact with the inner wall 30 when the slide hammer shaft 24 and connected impact element 32 slidably pass through the lower shaft lumen 26. The impact element 32 is preferably fixedly connected to the slide hammer shaft 24, and more preferably is formed integrally therewith. However, it is within the concept of the invention to provide an impact element 32 which is removably attached to the slide hammer shaft 24 to facilitate replacement if required.

At least one air vent and water drain 34, as best shown in FIG. 3B, is provided in the wall of the lower shaft portion 22 for purpose of allowing the free flow of air between the exterior and the interior of the lower shaft lumen 26, as the slide hammer shaft 24 is slidably moved up or down through the lower shaft lumen 26. The air vent and water drain 34 also serves to allow water to freely drain to the outside from the lower shaft lumen 26. A water drain 34*a* can be provided in the handle member 20 for purpose of avoiding water accumulation. Optionally, the impact element 32 can define at least one through bore 33, which continues along the longitudinal axis of the slide hammer shaft 24 before forming an exit from the slide hammer shaft 24. The at least one through bore 33 can serve to facilitate the flow of air during movement of the impact element 32 along the length of the lower shaft lumen 26.

Figure 2:
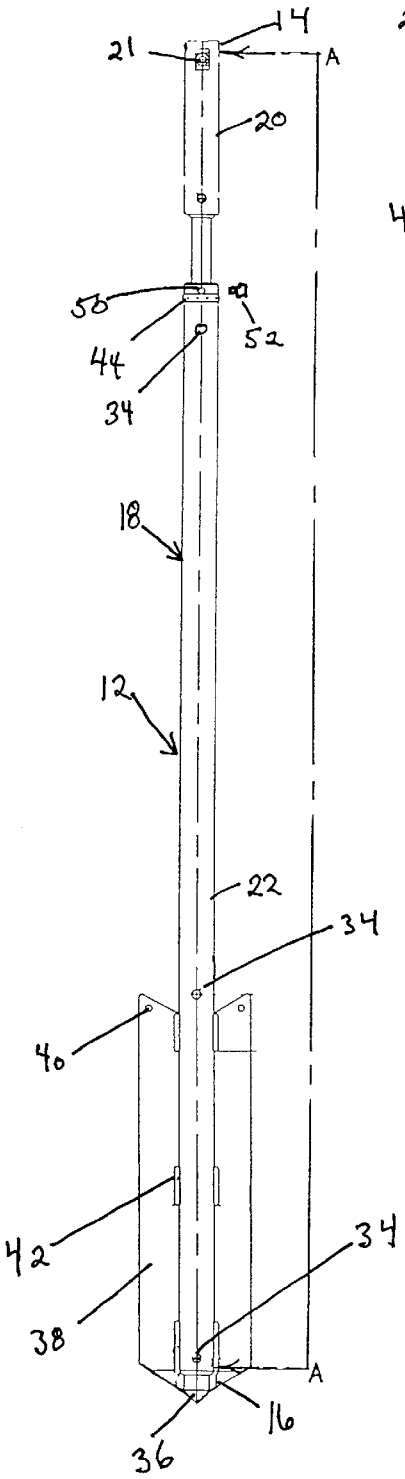
FIG. 2 is a frontal elevation view of the telescoping vertical support assembly of a preferred embodiment of the sign support system of the present invention.

A penetrator element 36 is positioned at the bottom end 16 of the vertical support assembly 12. The penetrator element 36 is manufactured of highly durable impact resistant material and is sized and configured to facilitate entry of at least part of the lower shaft portion 22 into the ground during installation of the vertical support assembly 12. The penetrator element 36 is preferably integrally formed with the installation impact surface 28 which can form the bottom wall of the lower shaft lumen 26. As best shown in FIG. 2, at least one penetrator fin 38 can be attached to the exterior surface of the lower shaft portion 22. Preferably the vertical support assembly will be configured with two penetrator fins 38 which can be approximately evenly spaced, in relation to each other, around the outside of the lower shaft portion 22 and in a vertical position proximate to the bottom end 16. More preferably, the penetrator fins 38 will be configured to present a blade-like shape aligned along the longitudinal axis of the lower shaft portion 22 and having the edge aligned so as to facilitate cutting into the ground as the penetrator element 36 is driven into the ground by the action of the impact element 32 being quickly forced down against the installation impact surface 28.

The penetrator fin 38 can define at least one anchoring point 40 which can be configured as a hole at a point on the penetrator fin 38 most distal to the penetrator element 36. The purpose of the anchoring point 40 is to provide a position and connecting point on the lower portion of the vertical support assembly 12 which permits the secure connection of any attachments or cords to the assembly 12.

Alternatively, the anchoring point can be configured as an attached or integrally formed loop, hook, knob, or other secure attachment point. As best shown in FIG. 2, the penetrator fin 38 can be provided with at least one penetration and extraction enhancer 42. The purpose of the penetration and extraction enhancer 42 is to facilitate ease of movement through the ground during the installation or extraction process of the vertical support assembly 12 by disrupting the possible suction effect of the ground most proximate to the assembly during use. The penetration and extraction enhancer 42 can be configured as a slit aligned along the longitudinal axis of the vertical support assembly, as surface disruption ridges or grooves, or any other configuration or surface design which serves to disrupt the suction effect of the ground during movement of the penetration element 36 and the penetration fin into or out of the ground.

As best shown in FIG. 3C, a lower shaft portion cap element 44 can be provided which is circumferentially disposed around the slide hammer shaft 24 and is secured to the upper limit of the lower shaft portion 22, so as to provide an upper terminus for the lower shaft lumen 26. The circumferential disposition of the cap element 44 permits the movement of a portion of the slide hammer shaft 24 into and out of the lower shaft lumen 26. The cap element 44 also serves to restrain the full exit of the slide hammer shaft 24 from the lower shaft portion 22 due to the blocking action of the cap element 44 that occurs when the slide hammer shaft 24 is pulled out of the lower shaft lumen 26 to the point that the impact element 32 makes restrictive contact with the cap element 44. The impact element 24, being sized to extend laterally outward beyond the cross dimension of the slide hammer shaft 24 forms an extraction impact ledge 48, which can make contact with the inner surface of the cap element 44, thus restraining the full removal of the slide hammer shaft 24 from the lower shaft lumen 26.

Proximate to, or preferably integrally formed with, the cap element 44, is an extraction impact surface 46. The extraction impact surface 46 is manufactured of impact resistant materials so as to withstand forceful and repeated impacts which might be required to extract the vertical support assembly 12 from the ground into which it had earlier been installed. A slide hammer shaft lock access 50 is defined in the cap element 44. The lock access 50 is sized and configured to receive a shaft lock element 52. The lock element selectively releasably engages with the lock access 50 and, when fully engaged, the lock element contacts the slide hammer shaft 24, so as to securely hold the slide hammer shaft 24 in a selected position. This selectable locking function serves to permit the user to slidably position the slide hammer shaft 24 over a wide range of slide hammer shaft positions, thereby providing a height adjustment function for the vertical support assembly 12. Preferably, the lock access 50 can be a threaded bore which corresponds to the lock element 52 being a threaded bolt which can be tightened into a fully locked position, the end of the lock element 52 making firm contact with the slide hammer shaft 24. It is however, fully within the concept of the invention to provide for alternative devices which can be adapted to be useful for locking the extended slide hammer shaft 22 in a selected position, to include, for example, a cotter key and bore, a ratcheting collar, or other known devices for securing an extension shaft from within a larger diameter cylinder. A receptor bore 54 is provided from the exterior into the handle member beginning at the top end 14 and aligned along the longitudinal axis of the handle member 20. The receptor bore 54 is sized and configured to receive a top plug member 56, which facilitates the connection of attachments to the vertical support assembly. The handle member 20 can be provided with a weld nut 21 which can threadably engage a set screw 21*a* for purpose of removably connecting attachments to the handle member 20.

In the installation operation of the novel sign support system 10, the user can grasp the handle member 20 with one hand while steadying and positioning the lower shaft portion 22 with the other hand. The user can then pull the handle member 20 away from the bottom end 16 such that the slide hammer shaft 24 slides upward and extends outside and above the lower shaft lumen 26. The user can selectively extend the exposed portion of the slide hammer shaft 24 between the handle member 20 and the lower shaft portion cap element 44 to any degree not to exceed the point where the extraction impact ledge 48 contacts the extraction impact surface 46. Then, by quickly and downwardly sliding the handle member 20 back into its starting position proximate to the cap element 44, the impact element 32 at the bottom end of the slide hammer shaft 24 will be forcefully driven against the installation impact surface 28. The momentum of the cumulative weight of the handle member 20, the slide hammer shaft and the impact element under the force provided by the user's arm movement after traversing the distance between the selected extended position and the point of contact between the impact element 32 and the installation impact surface 28 combine to forcefully drive the installation impact surface 28 and the integrally connected penetrator element 36 and penetrator fin(s) 38 into the ground upon which the bottom-most point of the penetrator element 36 was positioned. By repeating this process as many times as necessary, the penetrator element 36, penetrator fin(s) 38 and a portion of the lower shaft portion 22 are firmly positioned in the ground. The vertical support assembly 12 can be effectively driven into hard ground because the structure of the self-installation feature of the present invention permits a relatively long throw of the impact element 32 of slide hammer mechanism prior to impact with the installation impact surface 28.

This long throw of the self-installation feature of the present invention works equally well when the procedure is reversed to enable self-extraction of the vertical support assembly from the ground. During the self-extraction process, the procedure is reversed and at the conclusion of the forceful movement of the handle member 20 in an upward direction toward the top end 14, the extraction impact ledge 48 can be caused to strike the extraction impact surface 46 with sufficient cumulative force to extract the penetrator element and penetrator fin(s) from the ground. Unlike conventional efforts to provide a self-installation and self-extraction mechanism and process for ground penetrating devices, the present invention has discovered the use of impact elements and impact surfaces which are positioned outside of the handle member 20 and sufficiently distanced one from another to permit the user to impart sufficient force to effectively complete the installation and extraction processes. Therefore, unlike prior efforts, the present invention provides a self-installation/self-extraction feature which can be effective even in hard ground. The penetration and extraction enhancer(s) 42 facilitate the self-installation and self-extraction processes by serving to decrease the suction effect that can be exerted by soil tightly packed around a penetrating object.

As best shown in FIG. 1, a preferred embodiment of the sign support system includes the vertical support assembly 12, the top plug member, generally shown at 56, tension members 58, horizontal sign supports, generally shown at 60, and an attachment connection member, generally shown at 62. The top plug member 56 is best shown in FIGS. 5A–C, and includes an upper connection bore 64 defined by an upper plate 66. The upper plate 66 is connected to a bore post 68, which is sized and configured to releasably yet securely engage the upper connector bore 64 of the handle member 20. A lateral plate extension 70 is integral with the upper plate 66. The plate extension 70 extends away from the axis of the bore post 68 and is configured to turn downward from the plane of the upper plate 66, thus forming an angled relationship to the upper plate 66. The lateral plate extension 70 defines a lateral extension elongated bore 72.

Figure 7A:
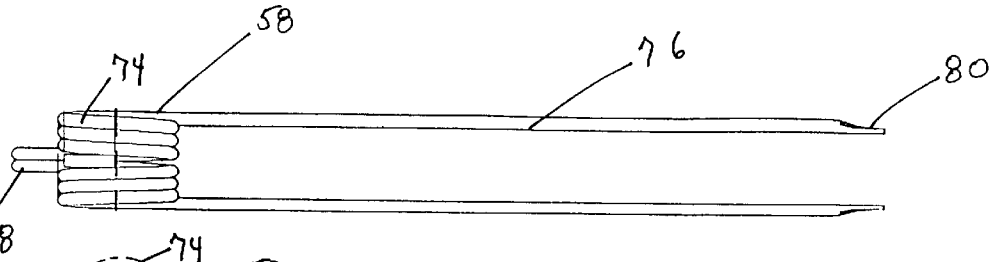
FIGS. 7A–B show a top view and side view, respectively of one embodiment of a tension member for use with the sign support system of the present invention.
Figure 7B:
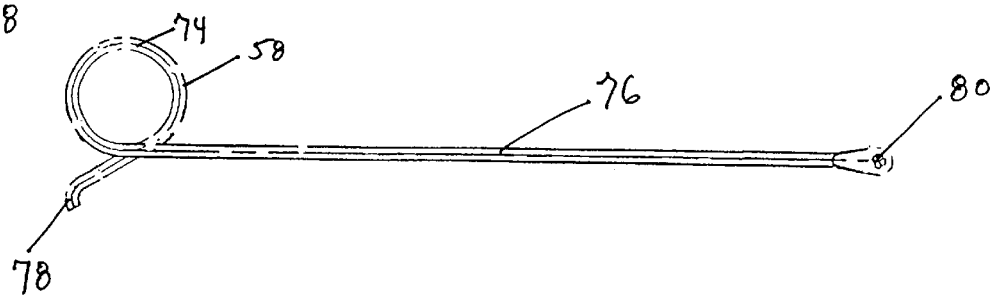
Figure 8:
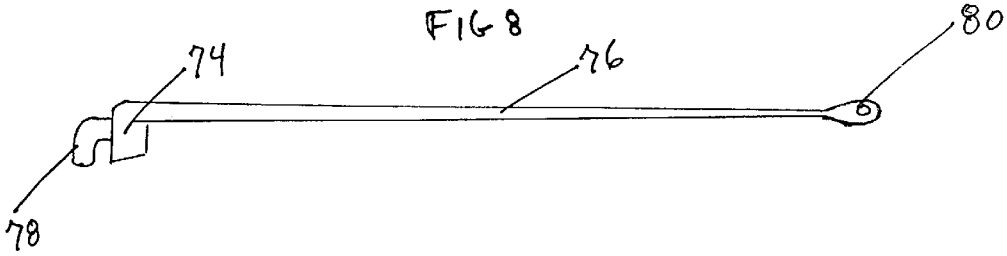
FIG. 8 shows a prospective view of an alternative embodiment of a tension member for use with the sign support system of the present invention.
Figure 9:
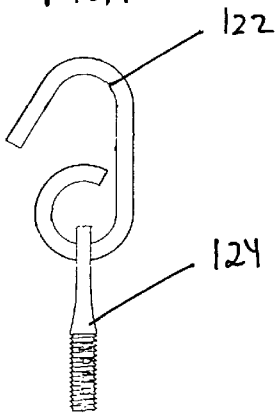
FIG. 9 shows a sign retention member coupled with one embodiment of a frame connector which can be used with the sign support system of the present invention.

The tension member 58 is formed of a strong resilient material and is configured to be removably attached to a variety of attachments provided for the sign support assembly to include for the embodiment shown in FIG. 1, the top plug member 56 and more specifically, the elongated bore 72 of the lateral plate extension 70. A preferred embodiment of the tension member 58 can be manufactured of high strength resilient material, such as steel and formed into a tensioner 74 with at least one elongate extension 76 configuration as shown in FIGS. 7A–B. Other materials which offer both strength and resiliency can also be used. A tension member hook element 78 extends from the tensioner 74 in a curving fashion and is sized and configured to interconnect with the lateral plate elongated bore 72 so as to form a releasable connection of sufficient stability to support the tension member 58 and provide a base upon which force exerted by the tension member 58 can be maintained with stability. The elongated extension 76 of the tension member 58 terminates in a tension member connector 80, which is configured to provide a secure releasable connection to one of a variety of horizontal supports which are adapted for use with the sign support system 10 and shown in detail in FIG. 4A. Alternative horizontal supports which can be used with other embodiments of the present invention are shown in FIGS. 4B–F. Alternatively, the tension member 58 can be formed of other resilient materials having high strength such as composite materials or polymeric resins and configured with more streamlined and esthetically pleasing designs such as that shown in FIG. 8.

It will be understood, that the concept of the present invention includes an embodiment, wherein only one tension member 58 is required. That single tension member 58 is positioned above or below and attached to a top or bottom edge of a sign, the remaining (top or bottom) edge of the sign can be attached to a non-tension member, such as for example a horizontal bar which is affixed at one end to the vertical support assembly. In such an embodiment, the non-tension member, the horizontal bar, would act simply to anchor one top or bottom edge of the sign while the single tension member 58 would provide a constant tension on the sign.

The horizontal sign support 60, shown in the preferred embodiment of FIG. 1, is shown in detail in FIG. 4A. The horizontal sign support 60 includes an elongate horizontal member 82, which has at least one fastening position 84 located proximate to each end of the elongate horizontal member 82. Disposed between the two ends of the elongate horizontal member 82 is at least one tension member connect point 86. In a preferred embodiment, the horizontal member 82 defines openings or holes which serve as the at least one fastening position 84 at each end and the tension member connect point 86. In the preferred embodiment, the tension member connect point 86 and the tension member connector 80 can be releasably connected by any number of ways well known in the art for making such connections, to include, for example a threaded bolt and nut, a cotter key, a releasable tie, or any other such device for making a releasable connection. It is within the concept of the present invention to fixedly make such a connection by means of a rivet or the like. The preferred embodiment shown in FIG. 1 depicts a cantilever sign display, the sign 88, having sign connection points 90, which can be configured as holes defined by the material of the sign 88. A soft or hard material sign 88 as shown in FIG. 1 can preferably be releasably secured to the fastening positions 84 on the elongate horizontal member 82 using S-shaped hooks 92, universal hooks 122 (FIG. 9), or any similar means of releasably connecting two parts as is known in the art.

FIGS. 4E–F show alternative embodiments of elongate horizontal members 82, which are configured to support horizontally over the ground, signs 88, which are not of a typical four-side (square or rectangular) configuration. FIG. 4E is an alternative embodiment of a horizontal member 82. The horizontal member 82 can be manufactured of a rigid material with a set curvature adapted to a specific curvature of an oval, semi-oval, or round shaped sign. A fixed-length horizontal member 82, such as that shown in FIG. 4E can also be formed of a pliable, yet resilient, material, which can be conformed to closely match the shape of a specific oval, semi-oval or round soft material sign; but, due to the resilient nature of the material exert a constant force on the soft material of the sign, thus holding the sign tight and presenting an esthetically pleasing appearance. FIG. 4F shows another alternative embodiment which, much like the embodiment of FIG. 4E described immediately above, can be used to support a soft material sign of oval, semi-oval or round shape. The embodiment of FIG. 4F is further adaptable in that the horizontal member 82 is formed of two separate horizontal components 94*a*, 94*b* which are slidably linked together by two locking links 96. In a preferred embodiment, the locking links 96 can be locked into position by a link lock threaded bolt 98, which engages a link lock threaded bore 100. It is within the conception of the present invention for the two locking links 96 to be configured as one integral locking link adapted to connect the two overlapping horizontal components 94*a*, 94*b*. One of ordinary skill in the art would know that alternatively, a cotter key, locking pin, removable tie, or other like devices in place of the link lock threaded bolt 96 could be used to releasably connect two elements. In operation, this embodiment of the horizontal member 82 can be adjusted to fit the size of a particular sign prior to locking the two locking links 96. A detail figure of a sliding linkage using locking links 96 is provided in FIG. 11. The embodiment of the present invention shown in FIG. 11 is not the same embodiment as that for which the horizontal member 82 of FIG. 4F is used; however, the design and principle of the sliding linkage using locking links 96 is the same and accordingly is instructive to one of ordinary skill in the art.

Figure 10:
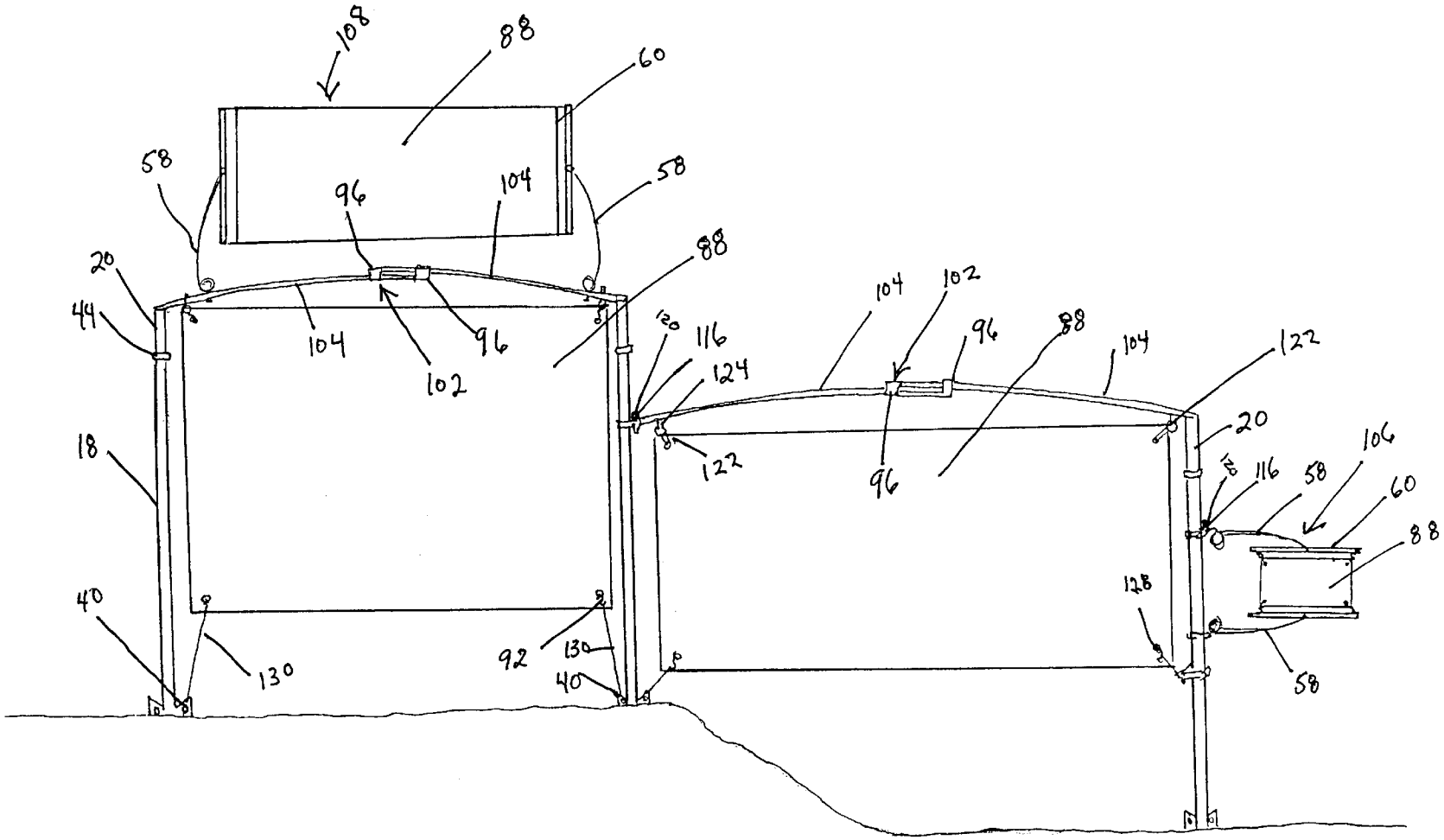
FIG. 10 is a front elevation view of a second embodiment of the sign support system of the present invention showing a multi-pole application, wherein vertical support members are connected by a crossbar assembly and the sign support system is installed on level terrain with the options of at least one additional sign support being attached to the sign support system and a step-down attachment for placing an attached additional sign support on adjacent uneven terrain also being shown.
Figure 16A:
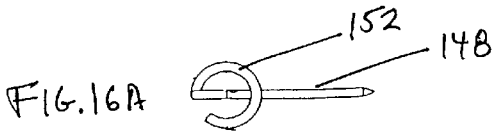
FIGS. 16A–B show a top view and a side view, respectively of an optional banner support member for use with the sign support system of the present invention.
Figure 16B:
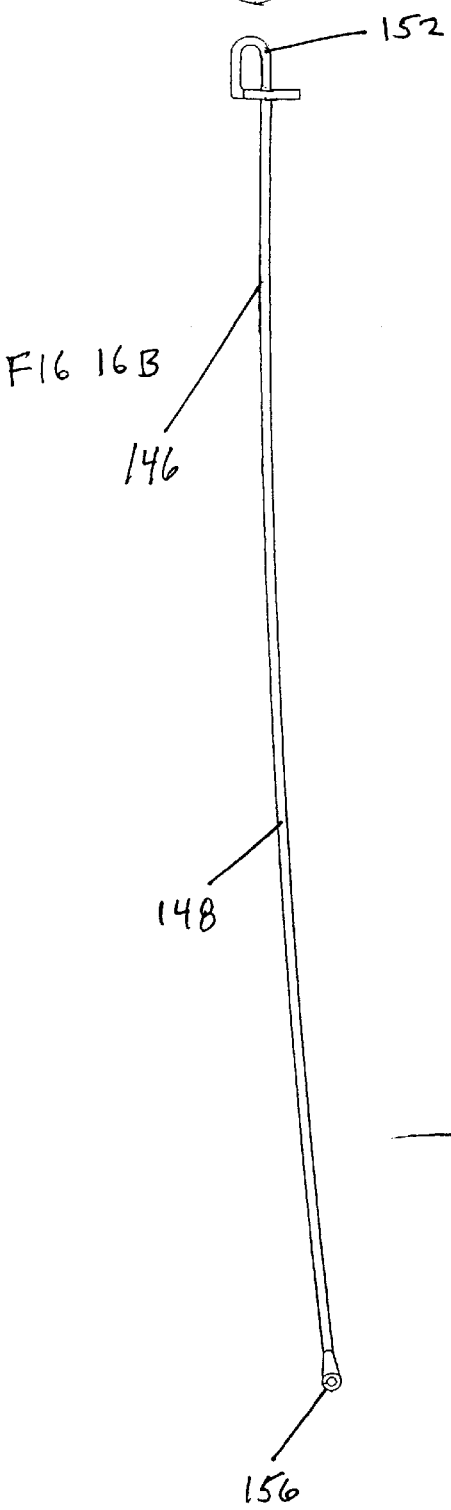
Figure 16C:
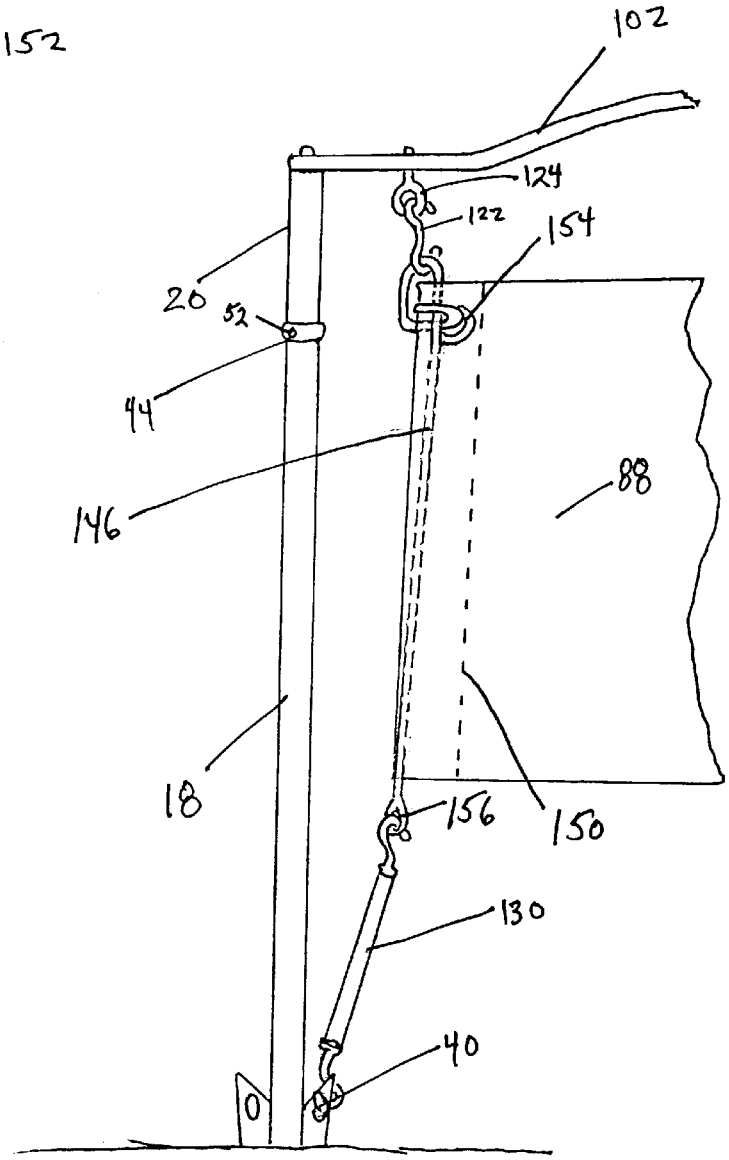
FIG. 16C shows a partial view of the sign support system employing the optional banner support member with a soft material sign.

As best shown in FIGS. 10–15, the sign support system 10 can be configured to provide a wide variety of sign displays not obtainable by temporary sign systems currently known in the art. FIG. 10 shows the sign support system 10 configured using a unique combination multiple vertical support assemblies 12 interconnected by a uniquely designed crossbar assembly, generally shown at 102. The sliding linkage using the locking links 96 is adapted to this embodiment by slidably connecting two crossbar members 104 to provide a strong, rigid attachment between two vertical support assemblies 12.

The crossbar assembly 102 can be provided in a linear configuration which after assembly with the vertical support assemblies 12 is positioned along its length in a relatively horizontal relationship to the ground in which the vertical support assemblies are implanted. Alternatively, the crossbar assembly 102 can be provided with an upwardly directed arch, which serves to provide a bias directed toward each end of the crossbar assembly, the bias being transmitted to the connected vertical assemblies 12 and serving to keep a sign mounted in the sign support system 10 in a tight fitting relationship. An arch in the crossbar assembly 102 further serves to permit the assembly to absorb some of the wind energy which might be directed against a connected sign by allowing the crossbar assembly 102 to flex slightly in an upward direction in response to such wind energy. A preferred configuration of the crossbar assembly 102 is in a continuous radius arch along the length of the crossbar assembly 102. Such a configuration also facilitates compact storage of the assembly when not in use. The tension members 58, which were fully discussed with regard to the embodiment of the invention shown in FIG. 1, can be used with the multi-vertical-support embodiment shown in FIG. 10 to provide a cantilever sign support, generally shown at 106, and a top rider sign support, generally shown at 108. In the attachment of a top rider support 108, the tension members 58 removably secure to crossbar elongated openings 110 with the same ease that the tension members 58 secure to the lateral plate elongated bore of the top plug member in the embodiment of FIG. 1. Similarly, in the attachment of a cantilever sign 106, the tension members 58 can easily secure to the attachment connector elongated openings 112 of the alternative bar attachment connector 114, shown in FIG. 6A or, alternatively, to the elongated openings 144, shown in FIG. 15A–C.

Unlike any conventional temporary sign support, the sign support system 10 of the present invention provides the structure, design and easily combined configuration necessary to present a wide variety of temporary sign displays using the common components of the invented system. FIG. 6B and FIG. 10 show a step down clamp 116 that enables the sign support system 10 to be configured for a laterally disposed multi-array of connected sign supports that traverses dramatically uneven terrain. In use, a crossbar member connecting bore 118, which can be threaded, is defined in the step down clamp 116. The step down clamp 116 permits easy connection of a crossbar member 104 using a crossbar connector 120 at any point on the elongated vertical shaft 18 of the vertical support assembly 12. The preferred embodiment for a crossbar connector is a threaded bolt adapted to threadably engage the cross bar member connecting bore 118. It is fully within the scope of the invention to use other non-threaded forms of connectors. A universal hook member 122 can be employed with a threaded eye bolt 124, which is adapted to engage cross bar threaded or unthreaded bores 126 to provide a simple dependable attachment point, which is easily suspended from the cross bar assembly 102 for purpose of supporting a sign 88.

Eyelets 128 in the four corners of the sign 88 can be connected to the universal hook members 122 directly at the top corners of the sign 88 or alternatively, can be linked to the universal hook members 122 by employing a connecting member 130 equipped with hook attachments. The connecting member can be for example, an elastic cord, a spring, a tie (such as a cord or rope), or the like. Eyelets 128 at the bottom corners of the sign can be attached similarly to anchoring points 40 or alternatively, for sign support systems which are configured for uneven terrain, as shown in FIG. 10 and FIG. 13, the bottom eyelets can be attached using connecting members 130 to step down clamps 116 or other devices. FIG. 13 shows the sign support system 10 configured with two vertical support assemblies 12 connected by a crossbar assembly 102 and positioned on uneven terrain. The independent height adjustment feature for each of the vertical support assemblies 12 permits the sign support system to be placed on virtually any type of terrain and still maintain a level presentation of the connected sign 88. As shown in FIG. 13, the displayed sign 88 remains in a level presentation, as does the crossbar assembly 102. The flexibility of extending or retracting the crossbar assembly 102 to provide a sign support system 10 width adjustment provides equal versatility in the horizontal plane and accordingly permits the adjustment of the system to accommodate a large variety of sign sizes and spatial limitations which might be imposed on a user.

Another embodiment of the sign support system 10 is configured to support a flexible two-sided, head-to-head printed sign on a single vertical support assembly 12. This embodiment is best shown in FIG. 14. The upper bar 132 is configured to permit the flexible sign to be draped over the upper bar 132. Upper bar elongated bores 134 are defined at each end of the upper bar 132. The upper bar elongated bores 134 provide attachment points for the connectors earlier described for use in attaching a sign 88 to the sign support assembly 10. The two-sided sign lower horizontal support 136 can be configured as shown in FIG. 14, or alternatively, as shown in FIGS. 4B–D, to have dual connection points 138 which are adapted to connect via S-shaped hooks 92, or connecting members 130, or any other similar connection device to the bottom edges of the two-sided sign displayed in the embodiment shown in FIG. 14. In the two-sided sign embodiment of FIG. 14, the lower horizontal support 136 employs a U-shaped bore 139, which is defined in the lower horizontal support 136, in combination with a unique two-part clamp 140 as shown in FIG. 15A–C, to firmly grasp the lower shaft portion 22 of the vertical support assembly 12. Parallel threaded bores 142 which align the two parts of the two-part clamp are connected by threaded bolts (not shown) to provide a vice-like grip on the lower shaft portion 22. Alternatively, the bores 142 can be threaded on only one (either one) of the two-part clamp 140 to receive a threadably engaged cap screw (not shown) or optionally, the bores 142 can be unthreaded to receive a through-passing bolt which is threadably engaged with a nut oriented on the opposite side to hold the two-part clamp securely together. Tapped holes 143 can be defined through the two-part clamp to align with clamp receiver holes 143*a* defined in the lower horizontal support 136. Threaded or unthreaded connectors can be provided to releasably connect the aligned tapped holes 143 and clamp receiver holes 143*a* for purpose of releasably connecting the two-part clamp 140 to the lower horizontal support 136. An elongated opening 144 is configured to receive a tension member 58 for adaptations which require additional attachments. This unique embodiment provides the ease of installation using the self-contained slide hammer mechanism of the vertical support assembly with the simplicity of a single vertical support for a soft material two-sided head-to-head designed sign.

Another embodiment of the present invention provides for the attachment of a banner support member 146 which can be suspended from a universal hook member 122 or like connector attached to and extending below a crossbar assembly 102. The biased shaft element 148 of the banner support member 146 can be threaded within the seam 150 of a soft material sign, after which the unique configuration of the banner support member connecting end 152 can be interlaced by a user through an eyelet 154 of the sign. A banner support bottom connector 156 can be attached to an anchoring point 40 (or other connecting point on the vertical support assembly) by an connecting member 130, thus drawing the banner support 146 tight between the crossbar assembly 102 and the anchoring point 40. Similar connections at the other end of the sign can also be provided. The banner support member 146 is provided with a bias which, when fully installed in a soft material sign and attached to a sign support system, serves to pull the sign tight and present an esthetically pleasing and effective presentation of the sign display. The banner support member 146 can be provided in a variety of sizes and lengths to meet the requirements of different sized signs. The banner support member 146 can be manufactured of any material which is strong and provides a bias when installed with a sign. It is within the scope of the present invention to provide a telescoping banner support member 146 which can be adjusted in length to meet different sized sign requirements.

The present invention also encompasses the use of the unique crossbar assembly either alone or in use with other vertical supports to provide a support for signs or other requirements to suspend or display objects above the ground, such as, for example, awnings, tents, and the like.

It is within the scope of the present invention to provide a sign kit which includes the sign system disclosed above. The kit could also include some or all of the alternative features discussed herein, to include one or more precut signs manufactured of hard or soft material, soft sign materials which can be cut and shaped as desired by the user, marking materials such as paints, stains, stencils, precut letters or commonly used words with or without self-adhesion, adhesives, and the like necessary to prepare and inscribe a sign or banner. Such a kit could be provided in an appropriate package which could include instructions for use and provide for ease of carrying and storage.

The above description of the preferred and alternative embodiments of the present invention are provided for illustrative purposes and are not intended to limit the concept of the disclosed invention beyond the limitations of the claims.

What I claim is:

1. A sign support system comprising a vertical support assembly and a connected sign support for displaying a sign attached thereto, said vertical support assembly comprising:

a handle member;

a slide hammer shaft, said slide hammer shaft having a first end connected to said handle member and a second end terminating in an impact element disposed externally to said handle member, said impact element having an upwardly facing extraction impact ledge extending radially outward from said slide hammer shaft; and a tubular lower shaft portion having an upper end and a bottom end and a lumen defined there between having an upper limit and a bottom limit, said tubular lower shaft portion comprising an installation impact surface which defines said bottom limit of said lumen, a longitudinally aligned penetrator element integrally attached to the exterior surface of said bottom end, a cap element securely attached at said upper end of said tubular lower shaft portion and defining said upper limit of said lumen, said cap element being circumferentially disposed and slidably engaged around said slide hammer shaft such that said slide hammer shaft extends upwardly out of said lumen to said handle and extends downwardly within said lumen a sufficient length to reach said installation impact surface when said handle slide hammer shaft is slidably positioned downward in said tubular lower shaft portion, said cap element comprising an extraction impact surface facing toward said lumen, said extraction impact surface being adapted to receive forceful impacts from said extraction impact ledge of said impact element when said handle is moved away from said lower shaft portion;

a first tension member adapted to support a sign, said first tension member being attached to said handle member; and a second tension member adapted to support a sign, said second tension member being attached to said lower shaft portion.

2. The sign support system of claim 1, wherein said first and second tension members are longitudinally aligned and vertically separated one from the other.

3. The sign support system of claim 2, wherein said first and second tension members each exert a bias in the opposite direction of the other, first or second, tension member.

4. The sign support system of claim 1, wherein at least one of said tension members is longitudinally aligned and vertically separated from a non-tensioning horizontal sign support member, said one tension member and said horizontal sign support member being configured to support a sign therebetween.

5. The sign support system of claim 1 further comprising first and second horizontal sign supports, each of said first and second horizontal sign supports being adapted to be connected to a sign disposed therebetween, each of said first and second sign supports being adapted to be attached to said first and second tension members, respectively.

6. The sign support system of claim 1, wherein at least one of said tension members is manufactured of a resilient material.

7. The sign support system of claim 6, wherein said at least one of said tension members comprises at least one spring.

8. The sign support system of claim 1, further comprising at least one penetrator fin connected to the external surface of said lower shaft portion at a position proximate to said bottom end.

9. A sign kit comprising:

the sign support system of claim 1;

sign material precut and prepared to receive a message imprint;

message imprinting materials; and instructions for assembly and use of said sign kit.

10. The sign support system of claim 1, wherein said penetrator element is partially enclosed within said lumen.

11. A sign support system for displaying a sign on both the front and back of a single pole vertical support comprising a vertical support assembly and at least two horizontal supports, said vertical support assembly comprising:

a handle member, a top and a bottom;

a slide hammer shaft, said slide hammer shaft having a first end connected to said bottom of said handle member and a second end terminating in an impact element disposed externally to said handle member, said impact element having an upwardly facing extraction impact ledge extending radially beyond said slide hammer shaft; and a tubular lower shaft portion having an upper end and a bottom end and a lumen defined there between, said bottom end defining an installation impact surface proximate to the bottom limits of said lumen, a longitudinally aligned penetrator element integrally attached at said bottom end of the exterior surface of said lower shaft portion, an installation impact surface with said lumen and proximate to said bottom end of said lower shaft portion, a cap element securely attached at said upper end of said lower shaft portion and defining the upper limit of said lumen, said cap element being circumferentially disposed and slidably engaged around said slide hammer shaft such that said slide hammer shaft extends upwardly out of said lumen to said handle and extends downwardly within said lumen a sufficient length to reach said installation impact surface when said handle slide hammer shaft is slidably positioned downward in said tubular lower shaft portion, said cap element comprising an extraction impact surface facing toward said lumen, said extraction impact surface being adapted to receive forceful impacts from said extraction impact ledge of said impact element when said handle is moved away from said lower shaft portion; and said at least two horizontal supports comprising an upper horizontal support and a lower horizontal support, said upper horizontal support being adapted to releasably attach to said top of said handle at a point about centrally located on said upper horizontal support and extend at approximately a right angle to said vertical support assembly and said lower horizontal support being adapted to releasably attach to a position on said lower shaft portion of said vertical support assembly at a point about centrally located on said lower horizontal support and extend at approximately a right angle to said vertical support assembly, said lower horizontal support being aligned in parallel fashion directly beneath and separated from said upper horizontal support assembly, said upper horizontal assembly and lower horizontal assembly having a plurality of connection points which are adapted for connecting a soft material sign which can be draped over said upper horizontal support and connected to said plurality of connection points at each end of said sign.

12. A sign kit comprising:

the sign support system of claim 11;

sign material precut and prepared to receive a message imprint;

message imprinting materials; and instructions for assembly and use of said sign kit.

* * * * *